US010195669B2

(12) United States Patent
Binder et al.

(10) Patent No.: US 10,195,669 B2
(45) Date of Patent: Feb. 5, 2019

(54) PROCESS FOR THE SYNTHESIS OF NANOSTRUCTURED METALLIC HOLLOW PARTICLES AND NANOSTRUCTURED METALLIC HOLLOW PARTICLES

(71) Applicant: Universidade Federal de Santa Catarina—UFSC, Florianopolis (BR)

(72) Inventors: Roberto Binder, Joinville (BR); Valderes Drago, Florianopolis (BR); Gustavo Tontini, Florianopolis (BR); Aloisio Nelmo Klein, Florianopolis (BR); Cristiano Binder, Florianopolis (BR)

(73) Assignee: UNIVERSIDADE FEDERAL DE SANTA CATARINA—UFSC, Florianopolis (BR)

( * ) Notice: Subject to any disclaimer, the term of this patent is extended or adjusted under 35 U.S.C. 154(b) by 327 days.

(21) Appl. No.: 15/124,619

(22) PCT Filed: Mar. 9, 2015

(86) PCT No.: PCT/BR2015/050026
§ 371 (c)(1),
(2) Date: Sep. 8, 2016

(87) PCT Pub. No.: WO2015/135051
PCT Pub. Date: Sep. 17, 2015

(65) Prior Publication Data

US 2017/0014913 A1 Jan. 19, 2017

(30) Foreign Application Priority Data

Mar. 10, 2014 (BR) ..... 1020140054944

(51) Int. Cl.
*B22F 9/24* (2006.01)
*B22F 1/00* (2006.01)
(Continued)

(52) U.S. Cl.
CPC ..... *B22F 9/24* (2013.01); *B22F 1/0051* (2013.01); *C23C 18/1635* (2013.01);
(Continued)

(58) Field of Classification Search
CPC . C23C 18/1635; C23C 18/34; C23C 18/1657; B22F 9/24; B22F 1/0051;
(Continued)

(56) References Cited

U.S. PATENT DOCUMENTS

2012/0001354 A1 1/2012 Cai et al.

OTHER PUBLICATIONS

Guo, et al., Uniform Magnetic Chains of Hollow Cobalt Mesophyeres from One-Pot Synthesis and Their Assembly in Solution, Adv. Funct. Mater. 2007; 17: 425-430 (Year: 2007).*
(Continued)

*Primary Examiner* — Daniel McCracken
(74) *Attorney, Agent, or Firm* — Fay Sharpe LLP

(57) ABSTRACT

A process for the synthesis of nanostructured metallic hollow spherical particles, in which the metal is deposited onto sacrificial masks formed in a polymeric colloidal solution by the electroless autocatalytic deposition method. Deposition releases only gaseous products ($N_2$ and $H_2$) during the oxidation thereof, which evolve without leaving contaminants in the deposit. The particulate material includes nanostructured metallic hollow spherical particles with average diameter ranging from 100 nm to 5 μm and low density with respect to the massic metal. A process for compacting and sintering a green test specimen are also described.

17 Claims, 2 Drawing Sheets

(51) Int. Cl.
*C23C 18/16* (2006.01)
*C23C 18/34* (2006.01)

(52) U.S. Cl.
CPC ..... *C23C 18/1657* (2013.01); *C23C 18/34* (2013.01); *B22F 2001/0029* (2013.01); *B22F 2009/245* (2013.01); *B22F 2301/15* (2013.01); *B22F 2301/25* (2013.01); *B22F 2302/45* (2013.01); *B22F 2304/056* (2013.01); *B22F 2304/058* (2013.01); *B22F 2304/10* (2013.01)

(58) Field of Classification Search
CPC ..... B22F 2001/0029; B22F 2304/058; B22F 2304/056; B22F 2302/45; B22F 2301/25; B22F 2301/15; B22F 2009/245; B22F 2304/10
See application file for complete search history.

(56) References Cited

OTHER PUBLICATIONS

Deng, et al., Autocatalytic-assembly based on self-decomposing templates: a facile approach toward hollow metal nanostructures, RSC Adv. 2013; 3: 4666-4672 (Year: 2013).*
International Search Report dated Jul. 7, 2015 for International application No. PCT/BR2015/050026.
Written Opinion dated Jul. 7, 2015 for International application No. PCT/BR2015/050026.
International Preliminary Report on Patentability completed Jun. 13, 2016 for International application No. PCT/BR2015/050026.
Qingwei Zhu et al. "Facile synthesis of hollow and porous nickel microspheres by low temperature molecular self-assembly", Solid State Sciences, Elsevier, Paris, France, vol. 13, No. 2, Dec. 2010 (Dec. 2010), pp. 438-443, XP028129560, ISSN: 1293-2558, DOI: 10.1016.
Chen Huiyu et al. "Synthesis and characterization of hollow silver spheres at room temperature", Electronic Materials Letters, vol. 7, Issue 2, Jun. 29, 2011 (Jun. 29, 2011), pp. 151-154, XP055195320, DOI: 10.1007/s13391-011-0611-z.
Qi Liu et al. "Nanometer-Sized Nickel Hollow Spheres", Advanced Materials, vol. 17, No. 16, Aug. 18, 2005 (Aug. 18, 2005), pp. 1995-1999, XP055195316, ISSN: 0935-9648,DOI: 10.1002/adma.200500174.
C. Bernardi C et al. "Production and characterization of sub micrometer hollow Ni—P spheres by chemical reduction: the influence of pH and amphiphilic concentration", Journal of Materials Science, Kluwer Academic Publishers, BO, vol. 43, No. 2, Sep. 6, 2007 (Sep. 6, 2007), pp. 469-474, XP019552951, ISSN:1573-4803, DOI: 10.1007/510853-007-1829-X.
Cao, *Nanostructures & Nanomaterials*, London: Imperial College Press, 2004.
Mallory et al., *Electroless Plating—Fundamentals and Applications*, Orlando: American Electroplaters and Surface Finishes Society, 1990, ISBN 0936569077.
Groza, *Nanosintering*, NanoStructured Materials, vol. 12, pp. 987-992, 1999.
Singla et al., *Catalytic Behavior of Nickel Nanoparticles Stabilized by Lower Alkylammonium Bromide in Aqueous Medium*, Elsevier, Applied Catalysis A: General 323, 51-57, 2007.

* cited by examiner

PROCESS FOR THE SYNTHESIS OF NANOSTRUCTURED METALLIC HOLLOW PARTICLES AND NANOSTRUCTURED METALLIC HOLLOW PARTICLES

This application claims priority of the Brazilian patent application no. BR102014005494-4, filed on Mar. 10, 2014, the contents of which are integrally incorporated here by reference. The present invention relates to a process for the synthesis of nanostructured metallic hollow particles, in which the metal is deposited onto sacrifice masks formed in a polymeric colloidal solution by the autocatalytic electroless deposition method.

The nanostructured metallic hollow spheres obtained by the process of the exhibit significantly lower density than the metal bulk, which enables the use thereof in powder metallurgy and catalysis with lower consumption of material. The use of the particulate material in powder-metallurgy processing is also described.

DESCRIPTION OF THE PRIOR ART

Nanostructured materials have potential of application in various engineering areas, since, due to their reduced dimensions, they may have very distinct chemical, physical and mechanical properties with respect to the materials on a microscopic scale. For instance, surface atoms in metallic materials have longer interatomic distance and less force of linkage with their pairs, this effect being evidenced in nanometric materials, in which the volume occupied by the surface atoms may come to represent a significant amount of the total volume of a particle. This imparts unique properties to the nanostructured material, as for example, decrease in the melting point of the material (Cao, Nanostructures & Nanomaterials. London: Imperial College Press, 2004).

Document US 2012/0001354 A1 describes another important property of nanostructured materials, which consists in increasing the specific area of the material, thus increasing the potential of application on materials for catalysis by increasing their catalytic activity.

One of the forms of production of nanostructured materials used in the prior art is the autocatalytic electroless deposition.

The electroless deposition process is electrochemically rigid due to the simultaneous cathodic deposition of a metal and anodic oxidation of a reducing agent. This process is considered an autocatalytic reaction, since the deposit itself acts like a catalyst in the oxidation-reduction (Mallory, G. O. and Hadju, J. B. Electroless Plating—Fundaments and Applications. Orlando: American Electroplaters and Surface Finishes Society, 1990, ISBN 0936569077).

Through this electroless method it is possible to produce nanostructured transition materials like Ni, Pt, Pd, Au and Cu with the most varied morphologies, such as spheres, hollow spheres, sticks, hedgehogs with crystallite sizes smaller than 100 nm.

The reducing agent that is most commonly used in electroless deposition for most metals is sodium hypophosphite ($NaPO_2H_2$), which upon being oxidized releases the phosphorus element, which has strong attraction for transition metals and may incorporate up to about 14% by weight of interstitial P into the metallic deposit.

Another less common reducing agent is sodium borohydride ($NaBH_4$) which similarly incorporates boron into the deposit, but in smaller portions.

Contaminating elements may alter physical and chemical properties of the material, varying its efficiency depending on the proposed application. The incorporation of phosphorus into nickel, for instance, increases its resistance to chemical corrosion, but decreases its resistance to temperature, which causes precipitation of $Ni_3P$ phase and weakens the material by about 340° C. The incorporation of contaminants into magnetic metals also decreases the magnetic properties thereof, making it more difficult to remove the catalyzing particles after the end of a reaction. Therefore, the present invention brings about the production of nanostructured microscopic structures of pure metals, aiming at appropriate technologic segments like catalysis or alveolar metallic materials.

In this context, the reducing agent used in the present invention is hydrazine ($N_2H_4$), which has the advantage of releasing only gaseous products ($N_2$ and $H_2$) during tis oxidation, which evolve without leaving contaminants such as phosphorus or boron from other reducing agents.

One of the properties of interest of post-nanostructured materials is the large specific area of their particles. Processes dependent upon surface effects like sintering (Groza, J. R. Nanosintering. Nanostructured Materials. 1999; 12:987-992.) and catalysis (Abreviation, M. L.; Negi, A.; Mahajan, V.; Singh, K. C.; Jain, D. V. S. Catalytic behavior of nickel nanoparticles stabilized by lower alkylammonium bromide in aqueous medium. Appl. Catal. A-Gen. 2007; 323:51-7.) may benefit much from this property.

Thus, the morphology of nanostructured metallic hollow spherical particles produced in the present invention have advantage for catalysis with respect to the dense or partly dense particles, since their nanometric structure forms nanopores that enable permeability to their internal surface.

A known method for obtaining hollow particles is electroless deposition onto sacrificial masks, which are removed after formation of the crust. The sacrificial masks commonly used for electroless deposition of metals are surfactants, the commonest of which being sodium sulfate dodecyl—SDS. (Bernardi, C.; Drago, V.; Bernardo, F. L.; Girardi, D.; Klein, A. N. Production and characterization of sub micrometer hollow Ni-P spheres by chemical reduction: the influence of pH and amphiphilic concentration. J. Mater. Sci. 2008; 43:469-74). Surfactants, when in solution, self-organize themselves into aggregates with characteristic morphologies depending on the molar concentration of the surfactant, composition, pH and temperature of the medium.

From the above variation of parameters, the molecules of the surfactant may form self-organized aggregates with the most varied forms, such as spheres, cylinders and plates, which can be used as masks for electroless deposition of metals. After removal of these masks, one obtains nanostructured metallic structures in the form of spherical crusts with dimensions varying from nano to micrometric. (Hosokawa, M. et al Nanoparticle Technology Handbook. Oxford: Elsevier, 2007. ISBN 978-0-444-53122-3).

In this regard, a new aspect of the invention is the use of polymers as sacrificial masks for electroless deposition of metals, wherein the polymers should be capable of forming spherical aggregates of negative zeta potential in a neutral or basic medium.

The utilization of these sacrificial-mask polymers in conjunction with a hydrazine reducing agent provides an effective process for the synthesis of nanostructured metallic hollow spherical particles, without incorporation of contaminants.

The use of the particulate material containing the nanostructured hollow spherical particles in powder-metallurgy processes also enables the processing of materials of lower density with alveolar porosity, with high capability of absorbing impacts and noises, maintaining properties of interest of the material such as resistance to corrosion, electrical and thermal conductivity and catalytic activity.

Therefore, the present invention describes processes for obtaining nanostructured hollow spherical particles of pure metals that are deposited on polymeric masks. These masks are evaporated and result in a particulate material composed by metallic spherical crusts of size and thickness that are controllable by the bath parameters. Their diameters may vary from 100 nm to 5 μm with low dispersion rate and the process is scalable with yields higher than 80%

A few forms of characterization of the material include X-ray diffraction to obtain its composition and crystallinity, electronic microscopy to obtain the average sizes and morphology of the particles and the Archimedes method for measuring the particle density. The yield is obtained from the ratio between the final product mass obtained and the atom mass of the metal present in the precursor reactants.

SUMMARY OF THE INVENTION

It is an objective of the invention to provide a process constituted by chemical baths for the synthesis of nanostructured metallic hollow spherical particles by using hydrazine as a reducing agent and sacrificial masks composed by a polymer that forms spherical aggregate of negative zeta potential in a neutral or basic medium.

The present process releases only gaseous products ($N_2$ e $H_2$) during the oxidation thereof, enabling the formation of pure metallic deposits, that is to say, without the presence of contaminants from the reducing agent.

A second objective of the invention is to obtain a particulate material composed by nanostructured metallic hollow spherical particles with average diameter between 100 nm and 5 μm and low density with respect to the bulk metal (or massic metal). The density of the particles depends on the composition, the average size, the morphology thereof, besides the thickness of the spherical crust being a fraction of the density of the bulk metal. In the case of hollow particles with average diameter of 550 nm, cited in Example 01, the average density of the particles is of 3.5 g/cm$^3$. The average density of the particles can be measured by means of the Archimedes method and depending on the reactants and parameters of the reaction it may be of from 20 to 90% of the value of the bulk metal density.

A third objective of the invention consists in using the particulate material containing the nanostructured metallic hollow spheres with application in the powder-metallurgy processing or as catalysts of chemical reactions

DETAILED DESCRIPTION OF THE INVENTION

The process of synthesis of the hollow spherical particles of the present invention consists of autocatalytic deposition without the aid of external potential, that is, electroless deposition) on polymeric sacrificial masks.

This synthesis technique has been improved in the present application, so that it could be possible to produce nanostructured hollow metallic spherical particles, without the need to add complexants, and so that the final product obtained will not have contaminants from the reducing agent.

More specifically, the process of the present invention consists of the following steps:

I. Dissolving at least one polymer that forms sacrificial mask in a neutral or basic aqueous solution, whereby a colloidal solution is obtained;

II. Adding at least one metallic salt to the solution obtained in step (I);

III. Adding to the solution obtained in step (II) at least one soluble base, in order to enable the formation of metallic hydroxide that is adsorbed on the masks; and IV. Adding hydrazine or a basic solution containing hydrazine for reducing the metallic hydroxide, forming a precipitate comprising the nanostructured crust of the pure metal on the sacrificial masks.

Prior to the synthesis, the materials (solution medium and reactants) to be employed in the present process of synthesis of autocatalytic deposition on sacrificial masks are chosen, so as to give rise to the hollow particles (product).

Particularly, the solution medium is an aqueous bath. The sacrificial mask former of step I comprises at least one polymer that forms spherical aggregates of negative zeta potential in a neutral or basic medium selected from: polyesters (such as polyetylene glycol, polypropylene glycol, polyvinyl acetate or other molecules that repeat ethers on the chain), similar synthetic polymers (such as polyvinyl alcohol and polyvinylpyrrolidone), anionic polyelectrolytes (such as poly (sodium sulfonate styrene) and block copolymers or mixture thereof.

By "negative zeta potential in neutral or basic medium" one understands a measure for definition of the electrokinetic potential in colloidal systems, determined by dynamic light spreading (DLS).

The greater the zeta potential module, the greater the stability of the colloidal suspension, wherein one achieves good stability for modules higher than 30 mV and excellent stability for modules higher than 60 mV, or a negative zeta potential between −30 mV to −60 mV. In the present invention the zeta potential of the colloidal suspension should be negative, so that the metallic hydroxide particles formed in step III are adsorbed on the surface of the polymeric masks.

The molecular mass of the above polymers may vary up to 200.000 u, being preferably between 1.000 to 20.000 u. For the formation of masks with diameters of 500 nm to 2 μm, one preferably uses polyethylene glycol with molecular mass 10.000 u.

The metallic salt (nickel, copper, palladium, gold, silver, chrome, zinc, tin, rhodium or other metals that are autocatalytic in an electroless reaction) added in step II is selected from: sulfates, chlorides, acetates, nitrates or mixtures thereof. For instance, for metal particles, preferably nickel sulfate is used, while palladium particles are formed preferably by using palladium chloride.

The solutions formed in steps I and II may be optionally subjected to ultrasound, so as to homogenize the morphology of the self-organized polymeric aggregates (masks) in the colloidal solution.

The soluble base added in step III consists of: sodium hydroxide, potassium hydroxide, ammonium hydroxide or mixtures thereof.

After addition of the soluble base, the pH of the solution in step III may have a controlled value between 7 and 14, or may vary between these values during the reaction. Preferably, the pH of the solution should be between 10 and 12, where the reducing potential of hydrazine is stronger.

Hydrazine is used in the process in the form of a hydrate, sulfate or chloride.

The ratio between mole concentration of hydrazine and of metallic salt should be higher than 1:4, and may comprise, for example, the ratios of 2:4, 3:3, 4:4, 4:1, 4:2, or 4:3, being preferably 4:1.

More specifically, the step I consists in dissolving $1.0\times10^{-}$to $1.0\times10^{-2}$ mole/L of the polymer used as sacrificial mask former in the solution. The ideal concentration of polymer is dependent upon its nature, the preferred polymer being polyethylene glycol (PEG) with average molecular mass between 1.000 and 20.000 u, and in a preferred embodiment one uses PEG with molecular mass 10000 u (PEG-10000) at the concentration of $1.0\times10^{-6}$ to $1.0\times10^{-4}$ mole/L.

The temperature of the solution during the synthesis may have a value between 20° C. and 100° C., or may vary during the process, resulting in a variation in the final sizes of the particles.

The process may be carried out either in an open vessel or by the reflux method.

In the open vessel, temperatures up to the boiling point of the bath are used. Preferably, the reflux method for temperatures close to the boiling point is used. The ideal temperature range for the reaction also depends on the metallic salt used, for instance for nickel salts, preferably temperatures between 75° C. and 95° C. are used. Stirring the mixture during the synthesis is important for homogenization of the saline concentrations and of the temperature.

Then, in step II, $1.0\times10^{-2}$ to 10.0 mole/L of metallic salt, selected from: sulfate, chloride, acetate, nitrate or the like, or mixtures thereof is added. Preferably, between 0.1 and 0.5 mole/L for salts having only one metal ion in the composition is used. The solution may then be subjected to ultrasound for dispersion and disaggregation of the polymer. Preferably, the synthesis temperature should be kept during the ultrasound.

After this, in step III, $1.0\times10^{-2}$ to 10.0 mole/L of a soluble base that is dissolved in the solution to form metallic hydroxides is added. Preferably, the molar concentration of the soluble base should be sufficient to transform all the metal ions of the salt into metal hydroxide. This hydroxide is then adsorbed in the polymeric masks due to the difference in zeta potential.

Finally, in step IV, hydrazine (in the form of hydrate, sulfate or chloride) at a molar ratio higher than 1:4 with respect to the metallic salt is added.

Optionally, one may add a soluble base (preferably the same one used in step III) to hydrazine before the aqueous solution is mixed, which increases the efficiency thereof as a reducing agent, making the reaction more rapid.

After addition of the reducing agent in step IV it is possible to observe the release of $N_2$ and $H_2$ gas bubbles, indicating that the hydrazine has begun to reduce the metal hydroxide. The beginning of the formation of bubbles may vary according to the reactants used, was well as the concentrations, stirring and temperature of the synthesis.

After the end of step IV, one separates the precipitate by washing with water and ethanol, with the aid of a centrifuge or a magnet to decant the particles.

The powder obtained from the precipitation is formed by metallic spherical crusts with the polymer enclosed inside them. Depending on the desired application, the material may then be calcined in an oven at a temperature between 100° C. and 500° C. to remove the polymer out of the porous nanostructured spherical crusts. This calcination may be made with or without the aid of vacuum, the latter facilitating the evaporation of the sacrificial masks.

The particle density depends on the composition, the average size, the morphology of thereof, and also from the thickness of the spherical crust being a fraction of the bulk metal density. In the case of hollow nickel particles with average diameter of 55 nm, described in Example 01, the average density of the particles is of 3.5 g/cm$^3$. The average density of the particles may be measured with the aid of a pycnometer, using the Archimedes method and depending on the reactants and parameters of the reaction it may be of 20 to 90% of the density value of the bulk metal.

In a preferred embodiment of the invention, as described in Example 01, the sacrificial mask former PEG 10000 and the metallic salt nickel sulfate is dissolved in a solution medium comprising distilled water. The solution is subjected to an ultrasound bath. In order to promote the formation of metallic hydroxides, sodium hydroxide dissolved in distilled water is added and, finally, a mixture of hydrazine and sodium hydroxide. After the incubation time of 10 minutes, on average, and intense evolution of gases, it is possible to observe the formation of precipitate. The precipitate is washed with water and ethanol with the aid of a magnet to decant the powder. Finally, the powder obtained is calcined in an oven under vacuum at 150° C.

Another embodiment of the invention, described in Example 02, consists in using PEG 10000 as a sacrificial mask former, dissolved in distilled water. A solution comprising palladium chloride ($PdCl_2$) and ammonium hydroxide ($NH_4OH$ 28%) is added. Then, the mixture is subjected to ultrasound. Finally, a solution with ammonium hydroxide and hydrazine is added. The precipitate formed is washed with water and ethanol with the aid of a centrifuge to decant the powder. Finally, the powder obtained is calcined in an oven under vacuum at 150° C.

The process of forming the nanostructured metallic hollow particles is demonstrated in FIG. 1.

The use of the particulate material containing the nanostructured hollow particles is directed to powder metallurgy, such as the formation of low-density bodies with alveolar porosity. One of the simplest and most rapid processes is that of uniaxial compaction and sintering. However, very fine powders like the materials produced in the following invention have low pourability, and therefore present difficulties in compaction, in order to make such a process feasible, one uses a granulation step (Mocellin, I. C. M. A contribution to the development of metallic porous structures via powder metallurgy. Engenharia Mecânica, UFSC. Florianópolis, 2012. Dissertação de Mestrado (master's thesis)), where a certain amount of organic ligand (that is: up to 5% by weight of paraffin) is mixed with the particulate material and dissolved with a small amount of organic solvent (that is: cyclohexane) in a revolving drum. The powder particles are covered by the ligand and, upon colliding against one another in the revolving drum, they aggregate, increasing the pourability of the material. The process for granulating, compacting and pre-sintering a green test specimen with the powder produced in Example 01 is descried in Example 03.

The particulate material containing the nanostructured hollow particles of the present invention can also be used as catalysts in chemical reactions.

self-organizing mask of the homopolymer;

the nanoparticles of the metallic hydroxide are adsorbed on the mask surface;

the nanoparticles of the hydroxide are gradually reduce;

final stage of the formation of the spherical porous metallic nanostructured crust, after removal of the mask.

Figure 1:
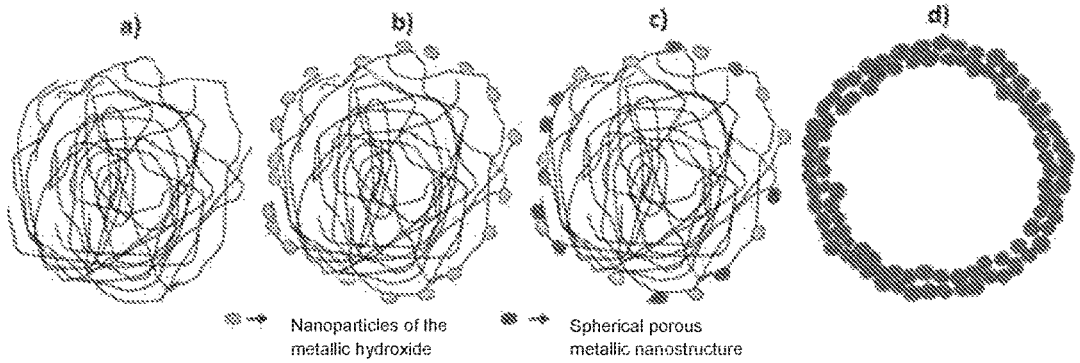
FIG. 1—Process for forming the nanostructured metallic hollow particles with self-organizing masks of a homopolymer, which comprises the following steps.
Figure 2:
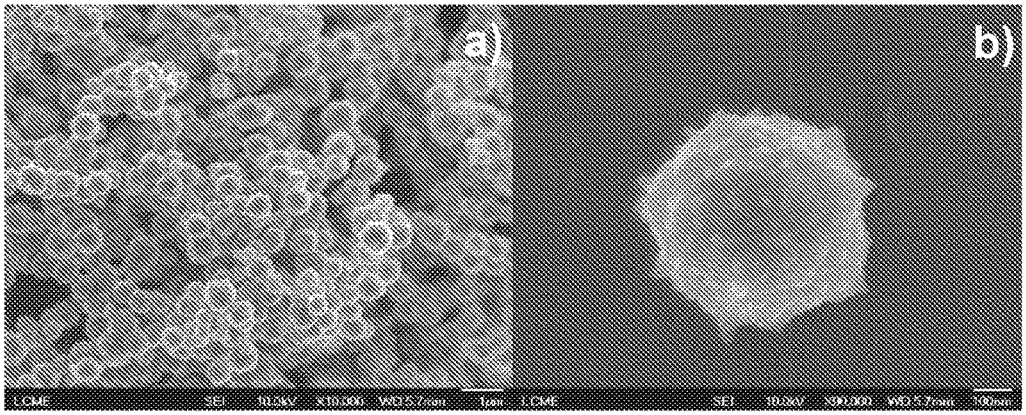

FIG. 2—MEVEC images with magnification of 10000× (a) and 90000× (b) of nanostructured hollow spheres of Ni with average diameter of 550 nm, produced in Example 01.

Figure 3:
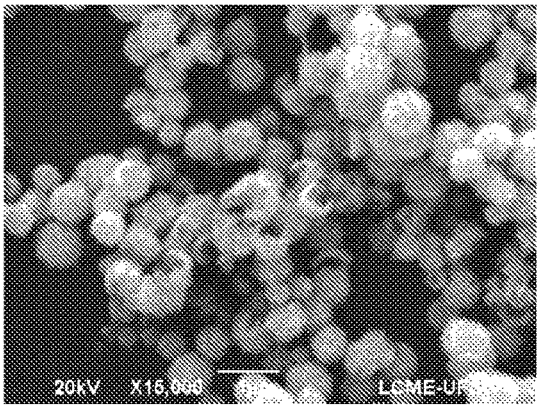

FIG. 3—MEV image of the particles produced in Example 01 partly corroded in an aqueous solution of nitric acid (C=10%), evidencing their hollow nature.

Figure 4:
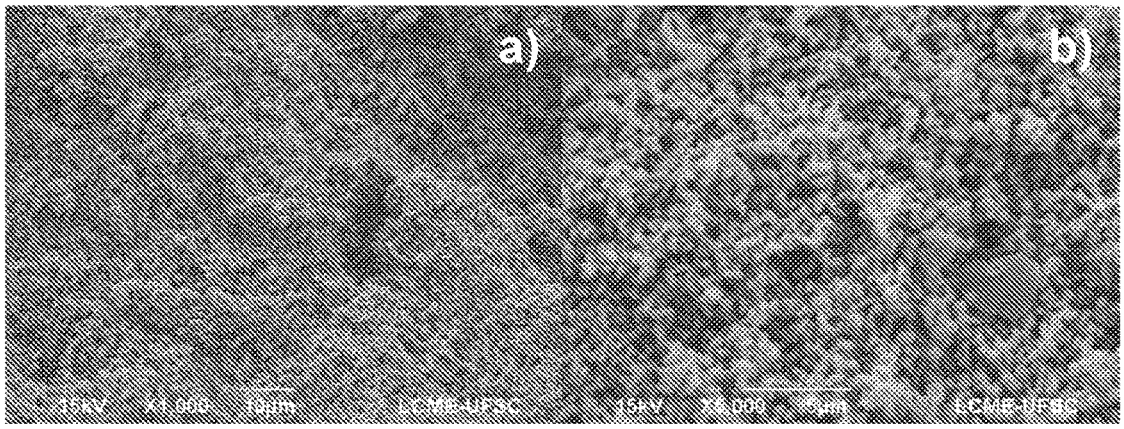

FIG. 4—MEV image with magnification of 1000× (a) and 5000× (b) of fractured region of a green test specimen produced in Example 03.

Examples of the present process of forming the nanostructured metallic hollow particles with self-organizing masks of homopolymer, and a preferred application of the particulate material for compacting and pre-sintering a green test specimen are presented, which do not have the objective of limiting the protection scope of the present invention, will be discussed as follows:

EXAMPLE 01

Process of Producing Particulate Material Containing Hollow Pure Ni Spheres

All the steps of this procedure are carried out with the following solutions under stirring at 80° C.

One dissolves 1.0 mg of polyethylene glycol (PEG 10000) in 15 ml of distilled water for 30 min.

The mixture is taken to an ultrasound bath for 10 min.

3,000 g of nickel sulfate ($NiSO_4.6H_2O$) are dissolved in 15 ml of distilled water and mixed with the preceding solution.

0.460 g of sodium hydroxide (NaOH) are dissolved in 10 ml of distilled water and mixed with the solution of item (c).

0.460 g of sodium hydroxide (NaOH) are dissolved in 10 ml of distilled water and then 2.44 ml of hydrazine hydrate ($N_2H_4.H_2O$) are added.

The solution of item (e) is then added slowly to the solution obtained in item (d).

The reaction begins to take place about 10 minutes after the reducing agent has been added (item f). Then, it is possible to observe an intense evolution of gases. In a little more than 20 minutes, the evolution of gases stops and the powder accumulates on the bottom of the container, leaving the remaining solution almost transparent. The final pH of the solution remains between 10 and 11.

The precipitate is washed with water and ethanol, with the aid of a magnet to decant the powder.

The final product is calcined in an oven under vacuum at 150° C. for 5 h.

The particulate material obtained in Example 01 is a black, magnetic, fine, loose powder, formed by rugous spherical hollow particles of pure Ni with average diameter of 550 nm.

The yield of the synthesis is of 90%, on average, calculated by considering the number of nickel moles in the final product divided by the number of moles present in the reactants ion the beginning of the synthesis.

The average density of the nanostructured metallic hollow particles obtained in this example is of approximately 3.5 $g/cm^3$.

FIG. 2 shows images of electronic scanning microscopy of the particulate material, and FIG. 3 shows images of the particulate material partly digested by nitric acid.

EXAMPLE 02

Process of Producing Hollow Pure Pd Spheres

All the steps of this procedure are carried out with the solutions under magnetic stirring and at 80° C.

0.300 g of palladium chloride ($PdCl_2$) and 3 ml of ammonium hydroxide ($NH_4OH$ 28%) are dissolved in 22 ml of distilled water with stirring for 20 min.

1.0 mg of polyethylene glycol (PEG 10000) is dissolved in 15 ml of water and added to the $PdCl_2$ solution.

The mixture is taken to an ultrasound bath for 10 min.

3 ml of ammonium hydroxide $NH_4OH$ (28%) and 0.2 ml of hydrazine ($N_2H_4.H_2O$ (99%)) are added in 17 ml of distilled water and then mixed to the mother solution.

The reaction occurs immediately after the reducing agent has been added (item d), making the solution black. The final pH of the solution remains between 10 and 11.

The precipitate is washed with water and ethanol, with the aid of a centrifuge to decant the powder.

The final product is calcined in an oven under vacuum at 150° C. for 5 h.

The particulate material obtained in Example 02 is a black, non-magnetic, fine and lose powder, formed by spherical hollow particles of pure Pd with average diameter of 250 nm.

The average yield is of 85%, calculated by considering the number of palladium moles in the final product divided by the number of moles present in the reactants in the beginning of the synthesis.

EXAMPLE 03

Preparation of a Green Test Specimen with the Product of Example 01 Through Powder Metallurgy The material obtained in Example 01 is mixed to 2% by mass of paraffin in a Becker. Cycloexane is added until it wets the whole powder to dissolve the paraffin, causing it to involve the particles. With the powder still wet, the Becker is inclined and axially rotated at a moderate velocity for about 15 minutes, until most of the organic solvent evaporates, leaving the particles covered with paraffin and agglomerating them, due to collisions between them during the rotation of the Becker. After the granulation process, the powder is dried for 24 h in a vacuum desiccator.

After granulation, the material is compacted in a hand-operated press with a double-effect compaction die, applying 100 MPa pressure.

With the objective to extract the organic ligand and to provide the green test specimen with more resistance to green, the latter is subjected to a pre-sintering process in standard-mixture atmosphere (95% $N_2$/5% $H_2$). Using a heating rate of 10° C./min, initially one ra ises it to a level of 500° C. for 30 min in order to remove the paraffin and then to a level of 700° C. for 40 minutes to pre-sinter the material.

Preferred examples of embodiment having been described, one should understand that the scope of the present invention embraces other possible variations, being limited only by the contents of the accompanying claims, which include the possible equivalents.

The invention claimed is:

1. A process of synthesis of nanostructured metallic hollow spherical particles with average diameter between 100 nm and 5 μm, in which the metal is deposited onto sacrificial masks by electroless autocatalytic deposition process, comprising:

I. dissolving at least one sacrificial mask forming a colloidal suspension of a polymer selected from polyether in a neutral or basic aqueous solution;

wherein the polyether is polyethylene glycol, polypropylene glycol, polyvinyl acetate, or other molecules that repeat ethers on the chain;

II. adding at least one metallic salt to the solution obtained in step (I);

III. adding at least one soluble base to the solution obtained in step (II); and IV. adding hydrazine or a basic solution containing hydrazine;

wherein the zeta potential of the colloidal suspension formed in step (I) by dissolving the at least one sacrificial mask should be negative, so that the metallic hydroxide particles formed in step (III) are adsorbed on the surface of the polymeric masks.

2. The process according to claim 1, wherein the sacrificial mask forming polymer comprises polyethylene glycol with average molecular mass between 1.000 and 20.000 u.

3. The process according to claim 1, wherein the sacrificial mask forming polymer comprises polyethylene glycol with molecular mass of 10,000 u.

4. The process according to claim 3, wherein the concentration of the sacrificial mask forming polymer in the solution obtained in step I ranges from 1.0×10-7 to 1.0×10-2 mol/L.

5. The process according to claim 4, wherein the concentration of the polyethylene glycol in the solution obtained in step I ranges from 1.0×10-6 to 1.0×10-4 mol/L.

6. The process according to claim 1, wherein the metallic salt added in step II comprises sulfates, chlorides, acetates, nitrates or mixtures thereof.

7. The process according to claim 6, wherein the concentration of the metallic salt in the solution obtained in step II ranges from 1.0×10-2 to 10.0 mol/L.

8. The process according to claims 1, wherein in that the concentration of the metallic salt in the solution obtained in step II ranges from 0.1 to 0.5 mol/L.

9. The process according to claim 1, wherein the soluble base added in step III is selected from: sodium hydroxide, potassium hydroxide, ammonium hydroxide or mixtures thereof.

10. The process according to claim 1, wherein the pH of the solution obtained in step III has a controlled value ranging from 7 to 14 or varies between these values during the reaction.

11. The process according to claim 10, wherein the pH of the solution obtained in step III has a value between 10 and 12.

12. The process according to claim 1, wherein the hydrazine or the basic solution containing hydrazine added in step IV is in the form of hydrate, sulfate or chloride.

13. The process according to claim 12, wherein the ratio between molar concentration of hydrazine and of metallic salt is higher than 1:4.

14. The process according to claim 1, wherein the ratio between the molar concentration of hydrazine and of metallic salt is of 4:1.

15. The process according to claim 1, wherein the synthesis takes place in an open vessel or by the reflux method.

16. The process according to claim 1, wherein the solutions described in steps I and II are subjected to ultrasound.

17. The process according to claim 1, wherein the precipitate obtained in step IV is subjected to calcination in an oven at a temperature ranging from 100° C. to 500° C. for removal of the polymeric mask.

* * * * *